US008240540B2

(12) United States Patent
Tanaka et al.

(10) Patent No.: US 8,240,540 B2
(45) Date of Patent: Aug. 14, 2012

(54) STRUCTURE FOR JOINING MEMBERS INCLUDING A NUT AND AN AUXILIARY MEMBER

(75) Inventors: Kazuharu Tanaka, Hino (JP); Hiroshi Fukuda, Hino (JP)

(73) Assignee: Hino Motors, Ltd., Hino-shi (JP)

( * ) Notice: Subject to any disclaimer, the term of this patent is extended or adjusted under 35 U.S.C. 154(b) by 496 days.

(21) Appl. No.: 12/447,495

(22) PCT Filed: Nov. 9, 2007

(86) PCT No.: PCT/JP2007/001227

§ 371 (c)(1), (2), (4) Date: Apr. 28, 2009

(87) PCT Pub. No.: WO2008/056448

PCT Pub. Date: May 15, 2008

(65) Prior Publication Data

US 2010/0064494 A1 Mar. 18, 2010

(30) Foreign Application Priority Data

Nov. 10, 2006 (JP) ..... 2006-304960
Jan. 25, 2007 (JP) ..... 2007-015557

(51) Int. Cl.
*B23K 20/12* (2006.01)
*B22D 3/00* (2006.01)

(52) U.S. Cl. ..... 228/2.1; 228/112.1; 428/544

(58) Field of Classification Search ..... 228/112.1
See application file for complete search history.

(56) References Cited

FOREIGN PATENT DOCUMENTS

| | | |
|---|---|---|
| JP | 2000 141066 | 5/2000 |
| JP | 2003 266183 | 9/2003 |
| JP | 2004 136365 | 5/2004 |
| JP | 2005 288525 | 10/2005 |
| JP | 2006 136906 | 6/2006 |
| JP | 2006 289409 | 10/2006 |

OTHER PUBLICATIONS

U.S. Appl. No. 12/518,142, filed Jun. 8, 2009, Fukuda.
U.S. Appl. No. 12/447,919, filed Apr. 30, 2009, Fukuda.
U.S. Appl. No. 12/513,026, filed Apr. 30, 2009, Fukuda.

*Primary Examiner* — Kiley Stoner
*Assistant Examiner* — Carlos Gamino
(74) *Attorney, Agent, or Firm* — Oblon, Spivak, McClelland, Maier & Neustadt, L.L.P.

(57) ABSTRACT

Provided is a structure for joining members applicable even to different members. Included are first and second plate-like members 1 and 2 to be joined which are stacked one on the other for face-to-face contact and formed with respective, mutually contiguous holes 3 and 4, a fastening member 5 formed with a threaded hole 20 contiguous with the holes 3 and 4 of the members 1 and 2 and abutting on the member 1 on a side away from the member 2 and an auxiliary member 7 inserted into the holes 20, 3 and 4 of the members 5, 1 and 2. Due to frictional heat and plastic flow, material derived from the member 7 is adapted to enter into a threaded groove on an inner periphery of the hole 20 of the member 5 and cover a circumference of the hole 4 of the member 2 so as to join the members 1 and 2 together.

16 Claims, 8 Drawing Sheets

STRUCTURE FOR JOINING MEMBERS INCLUDING A NUT AND AN AUXILIARY MEMBER

TECHNICAL FIELD

The present invention relates to a structure for joining members.

BACKGROUND ART

Friction stir welding or joining is a method for interconnecting members to be joined without fusion (see, for example, Patent Literature 1).

In the method, a workpiece comprising stacked members to be joined together is rested on a support tool or backing member. While rotated, a joining tool is pushed on the workpiece to assimilate together the materials softened due to frictional heat and plastic flow through stirring.

Then, the joining tool is released from the workpiece to allow the assimilated materials to solidify, thereby joining the members together.

The joining tool comprises a cylindrical shoulder and a short cylindrical pin coaxially contiguous with the shoulder, protruded as a tip of the tool and smaller in outer diameter than the shoulder.

[Patent Literature 1] JP 2004-136365A

SUMMARY OF INVENTION

Technical Problems

However, the technique in Patent Literature 1 is not applicable to joining of different members made of materials such as steel on the one hand and aluminum alloy on the other which significantly differ in hardness, softening temperature and other properties.

The invention was made in view of the above and has its object to provide a structure for joining members applicable to even different members.

Solution to Problems

In order to attain the above object, the invention provides first and second members to be joined, said members to be joined being stacked one on the other for face-to-face contact and formed with respective, mutually contiguous holes for insertion of an auxiliary member, a fastening member formed with an opening for insertion of the auxiliary member and contiguous with said holes of the members to be joined and abutting on the first member to be joined on a side away from the second member to be joined, and said auxiliary member inserted into the opening of said fastening member and said holes of the members to be joined, material derived from the auxiliary member being adapted to engage with the fastening member and second member to be joined, due to frictional heat and plastic flow.

The invention comprises first and second members to be joined, said members to be joined being stacked one on the other for face-to-face contact and formed with respective, mutually contiguous holes for insertion of an auxiliary member, a fastening member formed with an opening for insertion of the auxiliary member and contiguous with said holes of the members to be joined and abutting on the first member to be joined on a side away from the second member to be joined, and said auxiliary member inserted into the opening of said fastening member and said holes of the members to be joined, an inner surface defining the opening of the fastening member being formed with a peripherally extending groove, material derived from the auxiliary member being adapted to enter into said groove on the inner surface defining the opening of the fastening member and cover a circumference of the hole of the second member to be joined, due to frictional heat and plastic flow.

The invention comprises first and second members to be joined, said members to be joined being stacked one on the other for face-to-face contact and formed with respective, mutually contiguous holes for insertion of an auxiliary member, a fastening member formed with an opening for insertion of the auxiliary member and contiguous with said holes of the members to be joined and abutting on the first member to be joined on a side away from the second member to be joined, and said auxiliary member inserted into the opening of said fastening member and said holes of the members to be joined, material derived from the auxiliary member being adapted to engage with the fastening member and be assimilated with the second member to be joined, due to frictional heat and plastic flow.

The invention comprises first and second members to be joined, said members to be joined being stacked one on the other for face-to-face contact and formed with respective, mutually contiguous holes for insertion of an auxiliary member, a fastening member formed with an opening for insertion of the auxiliary member and contiguous with said holes of the members to be joined and abutting on the first member to be joined on a side away from the second member to be joined, and said auxiliary member inserted into the opening of said fastening member and said holes of the members to be joined, an inner surface defining the opening of the fastening member being formed with a peripherally extending groove, material derived from the auxiliary member being adapted to enter into said groove on the inner surface defining the opening of the fastening member and be assimilated with the second member to be joined, due to frictional heat and plastic flow.

The invention comprises first and second members to be joined, said members to be joined being stacked one on the other for face-to-face contact and formed with respective, mutually contiguous holes for insertion of an auxiliary member, a fastening member formed with an opening for insertion of the auxiliary member and contiguous with said holes of the members to be joined and abutting on the first member to be joined on a side away from the second member to be joined, and said auxiliary member inserted into the opening of said fastening member and said holes of the members to be joined, material derived from the auxiliary member being adapted to be assimilated with the fastening member and engage with the second member to be joined, due to frictional heat and plastic flow.

The invention comprises first and second members to be joined, said members to be joined being stacked one on the other for face-to-face contact and formed with respective, mutually contiguous holes for insertion of an auxiliary member, a fastening member formed with an opening for insertion of the auxiliary member and contiguous with said holes of the members to be joined and abutting on the first member to be joined on a side away from the second member to be joined, and said auxiliary member inserted into the opening of said fastening member and said holes of the members to be joined, material derived from the auxiliary member being adapted to be assimilated with the fastening member and cover a circumference of the hole of the second member to be joined, due to frictional heat and plastic flow.

The invention comprises first and second members to be joined, said members to be joined being stacked one on the other for face-to-face contact and formed with respective, mutually contiguous holes for insertion of an auxiliary member, a fastening member formed with an opening for insertion of the auxiliary member and contiguous with said holes of the members to be joined and abutting on the first member to be joined on a side away from the second member to be joined, and said auxiliary member inserted into the opening of said fastening member and said holes of the members to be joined, material derived from the auxiliary member being adapted to be assimilated with the fastening member and second member to be joined, due to frictional heat and plastic flow.

The invention comprises first and second members to be joined, said members to be joined being stacked one on the other for face-to-face contact and formed with respective, mutually contiguous holes for insertion of an auxiliary member, a first fastening member formed with a hole for insertion of the auxiliary member and contiguous with said holes of the members to be joined and abutting on the first member to be joined on a side away from the second member to be joined, a second fastening member formed with a hole for insertion of the auxiliary member and contiguous with the holes of said members to be joined and abutting on the second member to be joined on a side away from said first member to be joined, and said auxiliary member inserted into the hole of the first fastening member, the holes of the first and second members to be joined and the hole of the second fastening member, material derived from the auxiliary member being adapted to engage with the first and second fastening members, due to frictional heat and plastic flow.

The invention comprises first and second members to be joined, said members to be joined being stacked one on the other for face-to-face contact and formed with respective, mutually contiguous holes for insertion of an auxiliary member, a first fastening member formed with a hole for insertion of the auxiliary member and contiguous with said holes of the members to be joined and abutting on the first member to be joined on a side away from the second member to be joined, a second fastening member formed with a hole for insertion of the auxiliary member and contiguous with said holes of the members to be joined and abutting on the second member to be joined on a side away from the first member to be joined, and said auxiliary member inserted into the hole of the first fastening member, the holes of the members to be joined and the hole of the second fastening member, material derived from the auxiliary member being adapted to cover circumferences of the holes of the first and second fastening members, due to frictional heat and plastic flow.

The invention comprises first and second members to be joined, said members to be joined being stacked one on the other for face-to-face contact and formed with respective, mutually contiguous holes for insertion of an auxiliary member, a first fastening member formed with a hole for insertion of the auxiliary member and contiguous with said holes of the members to be joined and abutting on the first member to be joined on a side away from the second member to be joined, a second fastening member formed with a hole for insertion of the auxiliary member and contiguous with said holes of the members to be joined and abutting on the second member to be joined on a side away from the first member to be joined, and said auxiliary member inserted into the hole of the first fastening member, the holes of the members to be joined and the hole of the second fastening member, material derived from the auxiliary member being adapted to engage with the first fastening member and be assimilated with the second fastening member, due to frictional heat and plastic flow.

The invention comprises first and second members to be joined, said members to be joined being stacked one on the other for face-to-face contact and formed with respective, mutually contiguous holes for insertion of an auxiliary member, a first fastening member formed with a hole for insertion of the auxiliary member and contiguous with said holes of the members to be joined and abutting on the first member to be joined on a side away from the second member to be joined, a second fastening member formed with a hole for insertion of the auxiliary member and contiguous with said holes of said members to be joined and abutting on the second member to be joined on a side away from the first member to be joined, and said auxiliary member inserted into the hole of the first fastening member, the holes of the members to be joined and the hole of the second fastening member, material derived from the auxiliary member being adapted to cover a circumference of the hole of the first fastening member and be assimilated with the second fastening member, due to frictional heat and plastic flow.

The invention comprises first and second members to be joined, said members to be joined being stacked one on the other for face-to-face contact and formed with respective, mutually contiguous holes for insertion of an auxiliary member, a first fastening member formed with a hole for insertion of the auxiliary member and contiguous with said holes of the members to be joined and abutting on the first member to be joined on a side away from the second member to be joined, a second fastening member formed with a hole for insertion of the auxiliary member and contiguous with the holes of said members to be joined and abutting on the second member to be joined on a side away from said first member to be joined, and said auxiliary member inserted into the hole of the first fastening member, the holes of the first and second members to be joined and the hole of the second fastening member, material derived from the auxiliary member being adapted to be assimilated with the first fastening member and engage with the second fastening member, due to frictional heat and plastic flow.

The invention comprises first and second members to be joined, said members to be joined being stacked one on the other for face-to-face contact and formed with respective, mutually contiguous holes for insertion of an auxiliary member, a first fastening member formed with a hole for insertion of the auxiliary member and contiguous with said holes of the members to be joined and abutting on the first member to be joined on a side away from the second member to be joined, a second fastening member formed with a hole for insertion of the auxiliary member and contiguous with the holes of said members to be joined and abutting on the second member to be joined on a side away from said first member to be joined, and said auxiliary member inserted into the hole of the first fastening member, the holes of the first and second members to be joined and the hole of the second fastening member, material derived from the auxiliary member being adapted to be assimilated with the first fastening member and cover a circumference of the hole of the second fastening member, due to frictional heat and plastic flow.

The invention comprises first and second members to be joined, said members to be joined being stacked one on the other for face-to-face contact and formed with respective, mutually contiguous holes for insertion of an auxiliary member, a first fastening member formed with a hole for insertion of the auxiliary member and contiguous with said holes of the members to be joined and abutting on the first member to be joined on a side away from the second member to be joined, a second fastening member formed with a hole for insertion of the auxiliary member and contiguous with the holes of said members to be joined and abutting on the second member to be joined on a side away from said first member to be joined, and said auxiliary member inserted into the hole of the first fastening member, the holes of the first and second members to be joined and the hole of the second fastening member, material derived from the auxiliary member being adapted to be assimilated with the first and second fastening members due to frictional heat and plastic flow.

Advantageous Effects of Invention

According to a structure for joining members of the invention, excellent effects and advantages will be obtained as follows:

(1) In the invention, the auxiliary member may engage with the second member to be joined and the fastening member due to frictional heat and plastic flow, so that even if the first and second members to be joined are made of different materials, the members can be efficiently and reliably joined together.

(2) In the invention, the auxiliary member may be assimilated with the second member to be joined and engage with the fastening member due to frictional heat and plastic flow, so that even if the first and second members to be joined are made of different materials, the members can be efficiently and reliably joined together.

(3) In the invention, the auxiliary member may engage with the second member to be joined and assimilated with the fastening member due to frictional heat and plastic flow, so that even if the first and second members to be joined are made of different materials, the members can be efficiently and reliably joined together.

(4) In the invention, the auxiliary member may be assimilated with the second member to be joined and fastening member due to frictional heat and plastic flow, so that even if the first and second members to be joined are made of different materials, the members can be efficiently and reliably joined together.

(5) In the invention, the auxiliary member may engage with the first and second fastening members due to frictional heat and plastic flow, so that even if the first and second members to be joined are made of different materials, the members can be efficiently and reliably joined together.

(6) In the invention, the auxiliary member may engage with the first fastening member and assimilated with the second fastening member due to frictional heat and plastic flow, so that even if the first and second members to be joined are made of different materials, the members can be efficiently and reliably joined together.

(7) In the invention, the auxiliary member may be assimilated with the first fastening member and engage with the second fastening member due to frictional heat and plastic flow, so that even if the first and second members to be joined are made of different materials, the members can be efficiently and reliably joined together.

(8) In the invention, the auxiliary member may be assimilated with the first and second fastening members due to frictional heat and plastic flow, so that even if the first and second members to be joined are made of different materials, the members can be efficiently and reliably joined together.

REFERENCE SIGNS LIST

Figure 1:
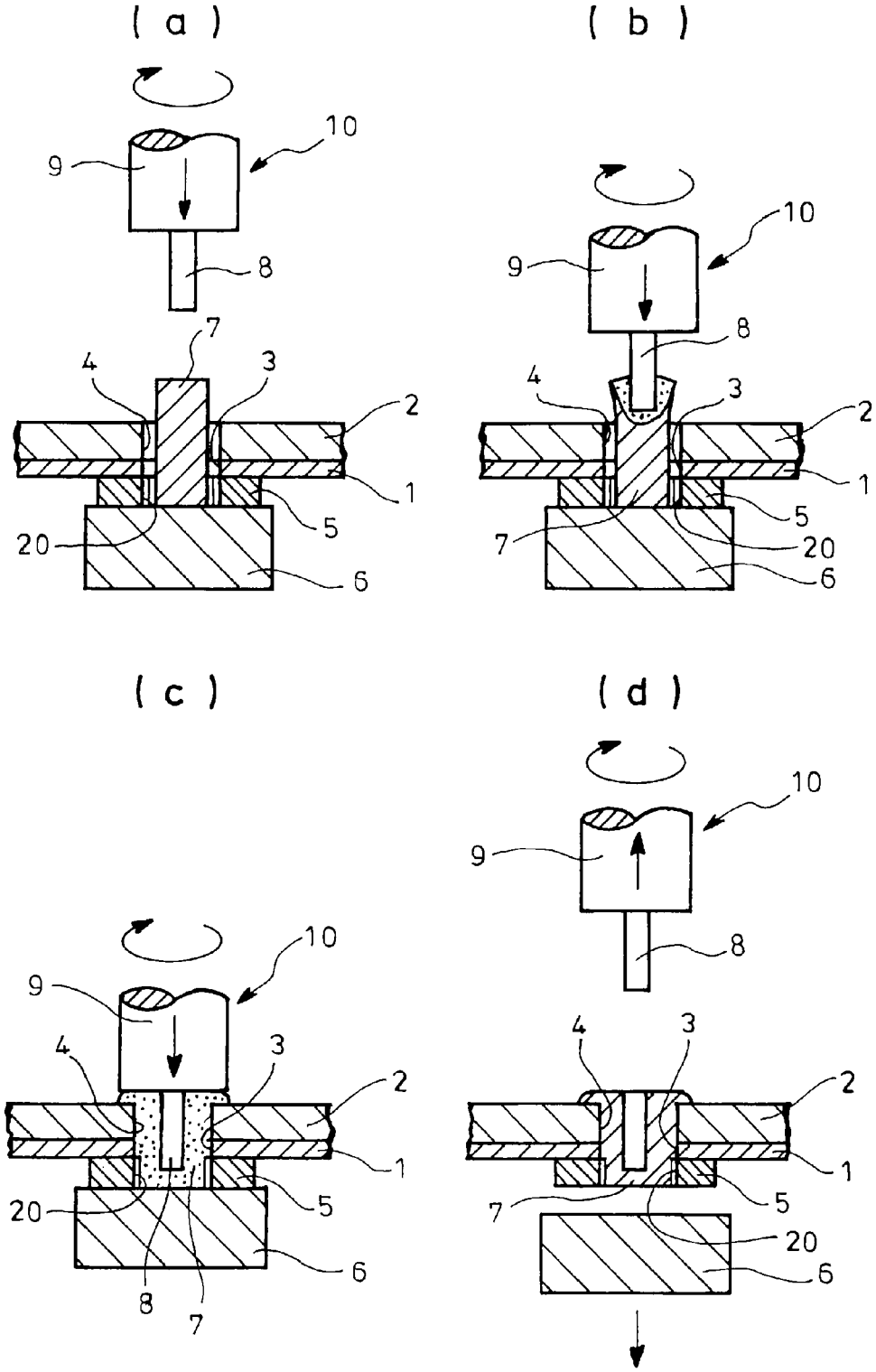
FIG. 1 includes schematic diagrams showing construction sequence of a first embodiment for a structure for joining members according to the invention.

1 first member to be joined
2 second member to be joined
3 hole
4 hole
5 fastening member
7 auxiliary member
11 first member to be joined
12 second member to be joined
13 hole
14 hole
15 first fastening member
16 second fastening member
19 auxiliary member
20 threaded hole
21 second member to be joined
22 hole
23 fastening member
24 hole
25 threaded hole
26 threaded hole
27 second fastening member
28 hole
29 first fastening member
30 hole

DESCRIPTION OF EMBODIMENTS

Embodiments of the invention will be described in conjunction with the drawings.

FIG. 1 is directed to a first embodiment of a structure for joining members according to the invention.

The structure for joining members comprises first and second plate-like members 1 and 2 to be joined which are stacked one on the other for face-to-face contact, a fastening member 5 abutting on the first member 1 to be joined on a side away from the second member 2 to be joined, and an auxiliary member 7.

The auxiliary member 7 is made of aluminum alloy, the second member 2 and the fastening member 5 being made of steel harder and higher in softening temperature than aluminum alloy.

The first and second members 1 and 2 are formed with coaxial holes 3 and 4, respectively, which extend through the respective members in a direction of thickness thereof.

The fastening member 5 is formed with a threaded hole 20 which is coaxial with the holes 3 and 4 of the members 1 and 2 and which extends through the member 5 in a direction of thickness thereof.

Alternatively, the threaded hole 20 may be a blind hole which does not extend through the member. Usable as the fastening member 5 is a nut or a cap nut.

As shown in (*a*) of FIG. 1, inserted in the holes 4, 3 and 20 is an auxiliary member 7.

The fastening member 5 may be preliminarily fixed to the first member 1 by welding or other technique.

As shown in (*d*) of FIG. 1, material derived from the auxiliary member 7 is closely contacted, due to frictional heat and plastic flow, with respective inner peripheries defining the holes 20, 3 and 4 of the members 5, 1 and 2 and caused to cover a circumference of the hole 4 of the member 2, thus the first and second members 1 and 2 being joined together by the auxiliary member 7.

The above-mentioned shaping of the auxiliary member 7 is conducted, using a backing member 6 and a joining tool 10.

The backing member 6 and the joining tool 10 are made of steel harder and higher in softening temperature than aluminum alloy.

The joining tool 10 comprises a short cylindrical pin 8 coaxially contiguous with a tip end surface of a cylindrical shoulder 9. The backing member 6 serves to receive the members 5 and 7.

While rotated, the joining tool 10 is pushed on an end surface, on a side adjacent to the second member 2 to be joined, of the auxiliary member 7 supported by the backing member 6, so that the auxiliary member 7 is softened due to frictional heat and plastic flow as shown in (*b*) of FIG. 1.

Then, as shown in (*c*) of FIG. 1, the material derived from the auxiliary member 7 enters a thread groove of the threaded hole 20 and covers a circumference of the hole 4 of the second member 2 to be joined.

Further, as shown in (*d*) of FIG. 1, the joining tool 10 is released from the auxiliary member 7 to allow the plastic flow portions of the auxiliary member 7 covering the hole 4 and closely contacting the threaded hole 20 to solidify, thus completing the joining of the first and second members 1 and 2 to be joined.

Thus, even if the first member 1 to be joined is made of steel just like the second member 2 to be joined or made of material other than steel which is significantly different in hardness, softening temperature and other properties, the members 1 and 2 can be efficiently and reliably joined together.

If the first member 1 to be joined is made of aluminum alloy just like the auxiliary member 7, the material derived from the auxiliary member 7 is assimilated with the first member 1.

If the first member 1 to be joined is relatively thin in comparison with the second member 2 to be joined, advisably the fastening member 5 may be preliminarily fixed to the first member 1 to be joined by welding or other technique. Such preliminary fixing brings about dispersion of shearing force applied by the fastening member 5 to the auxiliary member 7, and prevents rupture of the auxiliary member 7 even if forces are applied to the first and second members 1 and 2 in mutually shifted directions and prevents the first member 1 from being peeled.

Figure 2:
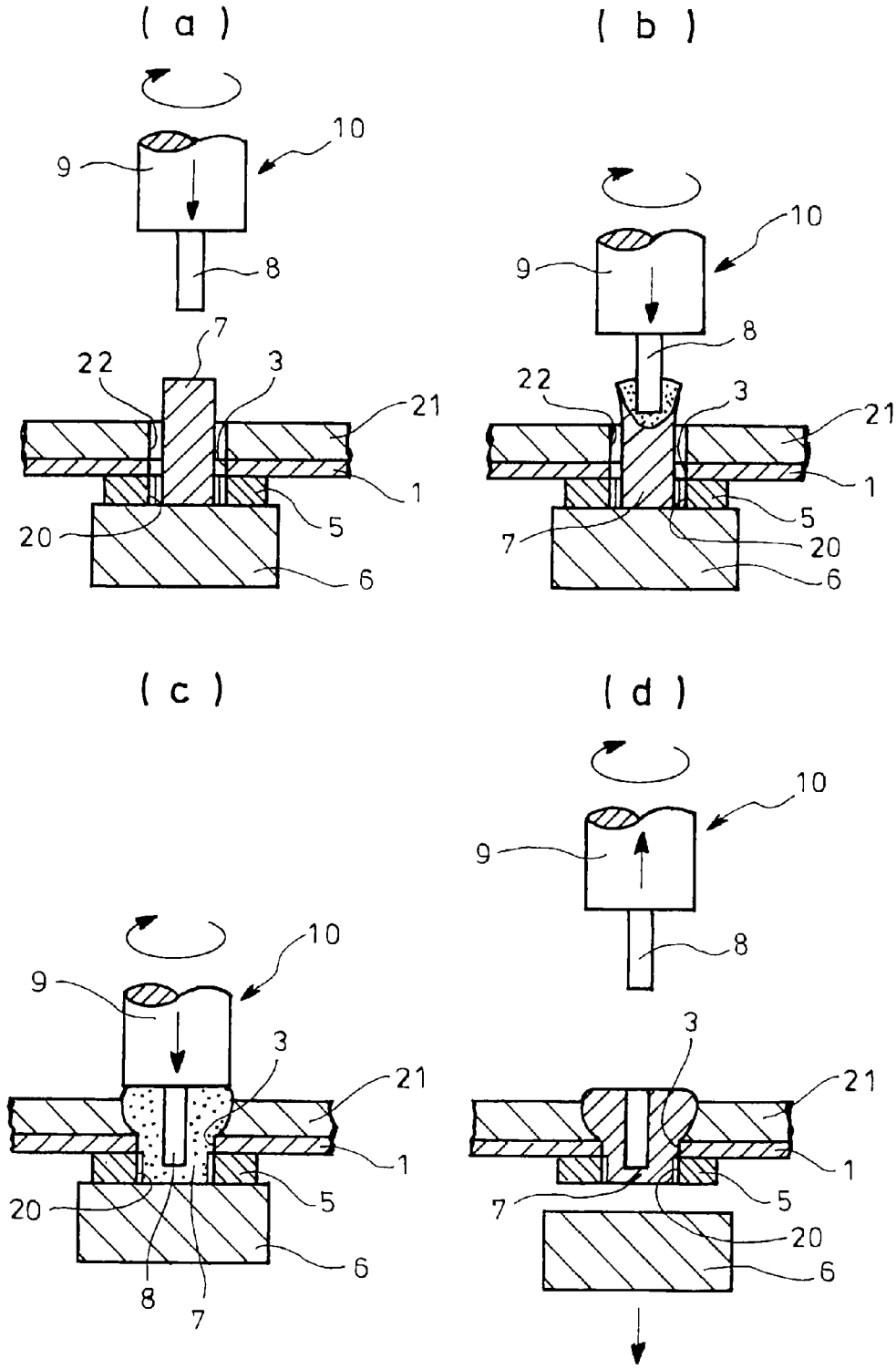
FIG. 2 includes schematic diagrams showing construction sequence of a second embodiment for a structure for joining members according to the invention.

FIG. 2 is directed to a second embodiment of a structure for joining members according to the invention in which parts similar to those in FIG. 1 are represented by the same reference numerals.

The structure for joining members comprises first and second plate-like members 1 and 21 to be joined which are stacked one on the other for face-to-face contact, a fastening member 5 abutting on the first member 1 to be joined on a side away from the second member 21 to be joined, and an auxiliary member 7.

The second member 21 and the auxiliary member 7 are made of aluminum alloy, the fastening member 5 being made of steel harder and higher in softening temperature than aluminum alloy.

The first and second members 1 and 21 are formed with coaxial holes 3 and 22, respectively, which extend through the respective members in a direction of thickness thereof.

The fastening member 5 is formed with a threaded hole 20 which is coaxial with the holes 3 and 22 of the members 1 and 21 and which extends through the member in a direction of thickness thereof.

As shown in (*a*) of FIG. 2, inserted in the holes 20, 3 and 22 is an auxiliary member 7.

The fastening member 5 may be preliminarily fixed to the first member 1 to be joined by welding or other technique.

As shown in (*d*) of FIG. 2, material derived from the auxiliary member 7 is closely contacted, due to frictional heat and plastic flow, with respective inner peripheries defining the holes 20 and 3 of the members 5 and 1 and assimilated with the second member 21, thus the first and second members 1 and 21 being joined together by the auxiliary member 7.

The above-mentioned shaping of the auxiliary member 7 is conducted, using a backing member 6 and a joining tool 10.

While rotated, the joining tool 10 is pushed on an end surface, on the side adjacent to the second member 21, of the auxiliary member 7 supported by the backing member 6, so that the auxiliary member 7 is softened due to frictional heat and plastic flow as shown in (*b*) of FIG. 2.

Then, as shown in (*c*) of FIG. 2, the material derived from the auxiliary member 7 enters a thread groove of the threaded hole 20 and is assimilated with the second member 2.

Further, as shown in (*d*) of FIG. 2, the joining tool 10 is released from the auxiliary member 7 to allow the plastic flow portion assimilated with the second member 2 and the plastic flow portion of the auxiliary member 7 closely contacted with the inner periphery defining the threaded hole 20 to solidify, thus completing the joining of the first and second members 1 and 21 to be joined.

Thus, even if the first member 1 to be joined is made of aluminum alloy just like the second member 21 to be joined or made of material other than aluminum alloy which is significantly different in hardness, softening temperature and other properties, the members 1 and 21 can be efficiently and reliably joined together.

If the first member 1 to be joined is made of aluminum alloy just like the auxiliary member 7, the material derived from the auxiliary member 7 is assimilated with the first member 1 to be joined.

If the first member 1 to be joined is relatively thin in comparison with the second member 21 to be joined, advisably the fastening member 5 may be preliminarily fixed to the first member 1 by welding or other technique; then, such preliminary fixing brings about dispersion of shearing force applied by the fastening member 5 to the auxiliary member 7, and prevents rupture of the auxiliary member 7 even if forces are applied to the first and second members 1 and 21 in mutually shifted directions and prevents the first member 1 from being peeled.

Figure 3:
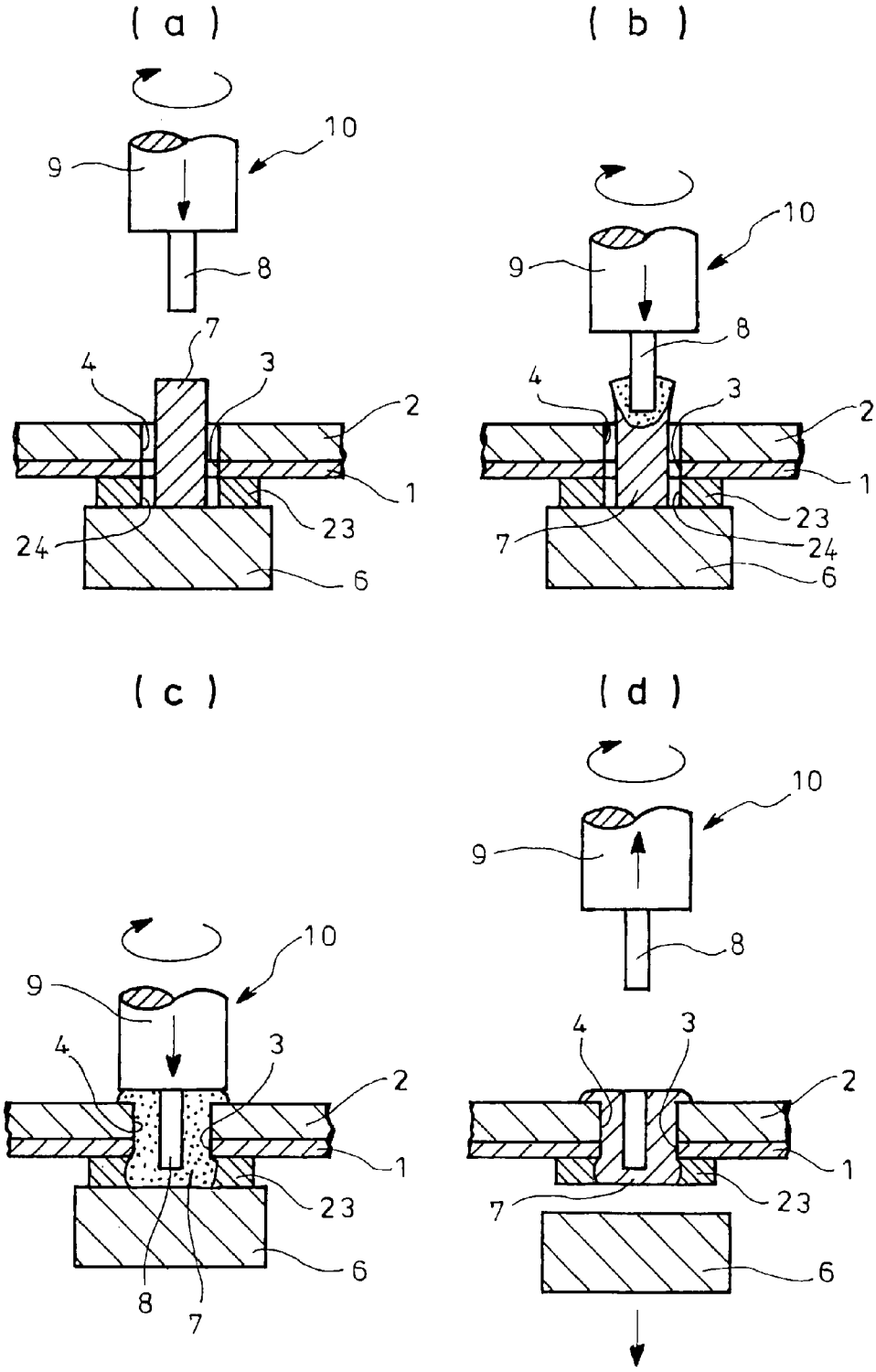
FIG. 3 includes schematic diagrams showing construction sequence of a third embodiment for a structure for joining members according to the invention.

FIG. 3 is directed to a third embodiment of a structure for joining members according to the invention in which parts similar to those in FIG. 1 are represented by the same reference numerals.

The structure for joining members comprises first and second plate-like members 1 and 2 to be joined which are stacked one on the other for face-to-face contact, a fastening member 23 abutting on the first member 1 on a side away from the second member 2 and an auxiliary member 7.

The fastening member 23 and the auxiliary member 7 are made of aluminum alloy, the second member 2 being made of steel harder and higher in softening temperature than aluminum alloy.

The fastening member 23 is formed with a hole 24 which is coaxial with the holes 3 and 4 of the members 1 and 2 and which extends through the member 23 in a direction of thickness thereof.

Alternatively, the hole 24 may be a blind hole which is opened to the first member 1 to be joined and does not extend through the member 23.

As shown in (a) of FIG. 3, inserted in the holes 3,4 and 24 is an auxiliary member 7.

The fastening member 23 may be preliminarily fixed to the first member 1 to be joined by welding or other technique.

As shown in (*d*) of FIG. 3, due to frictional heat and plastic flow, material derived from the auxiliary member 7 is assimilated with the fastening member 23 and closely contacted with the respective inner peripheries defining the holes 3 and 4 of the members 1 and 2 and caused to cover a circumference of the hole 4 of the second member 2 to be joined, thus the first and second members 1 and 2 to be joined being joined together by the auxiliary member 7.

The above-mentioned shaping of the auxiliary member 7 is conducted, using a backing member 6 and a joining tool 10.

The backing member 6 serves to receive the members 23 and 7.

While rotated, the joining tool 10 is pushed on an end surface, on a side adjacent to the second member 2, of the auxiliary member 7 supported by the backing member 6, so that the auxiliary member 7 is softened due to frictional heat and plastic flow as shown in (*b*) of FIG. 3.

Then, as shown in (*c*) of FIG. 3, the material derived from the auxiliary member 7 is assimilated with the fastening member 23 and caused to cover the circumference of the hole 4 of the second member 2.

Further, as shown in (*d*) of FIG. 3, the joining tool 10 is released from the auxiliary member 7 to allow the plastic flow portion of the auxiliary member 7 covering the hole 4 and the plastic flow portion of the auxiliary member 7 assimilated with the fastening member 23 to solidify, thus completing the joining of the first and second members 1 and 2 to be joined.

Thus, even if the first member 1 to be joined is made of steel just like the second member 2 to be joined or made of material other than steel which is significantly different in hardness, softening temperature and other properties, the members 1 and 2 can be efficiently and reliably joined together.

If the first member 1 to be joined is made of aluminum alloy just like the auxiliary member 7, the material derived from the auxiliary member 7 is assimilated with the first member 1 to be joined.

If the first member 1 to be joined is relatively thin in comparison with the second member 2 to be joined, advisably the fastening member 23 may be preliminarily fixed to the first member 1 to be joined by welding or other technique. Such preliminary fixing brings about dispersion of shearing force applied by the fastening member 23 to the auxiliary member 7, and prevents rupture of the auxiliary member 7 even if forces are applied to the first and second members 1 and 2 in mutually shifted directions and prevents the first member 1 from being peeled.

Figure 4:
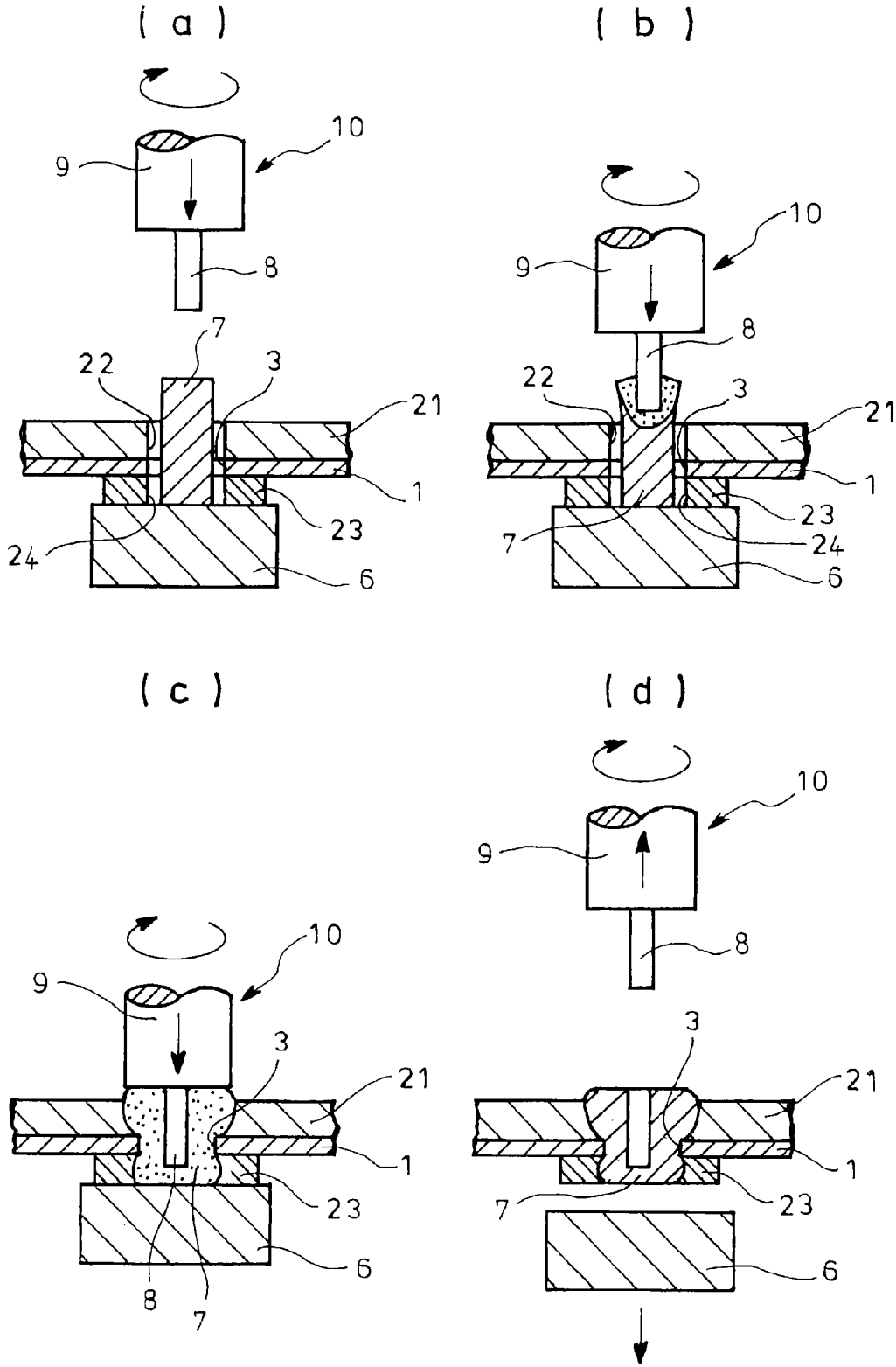
FIG. 4 includes schematic diagrams showing construction sequence of a fourth embodiment for a structure for joining members according to the invention.

FIG. 4 is directed to a fourth embodiment of a structure for joining members according to the invention in which parts similar to those in FIGS. 2 and 3 are represented by the same reference numerals.

The structure for joining members comprises first and second plate-like members 1 and 21 to be joined which are stacked one on the other for face-to-face contact, a fastening member 23 abutting on the first member 1 to be joined on a side away from the second member 21, and an auxiliary member 7.

The second member 21, the fastening member 23 and the auxiliary member 7 are made of aluminum alloy.

The fastening member 23 is formed with a hole 24 which is coaxial with the holes 3 and 22 of the first and second members 1 and 21 to be joined and which extends through the member 23 in a direction of thickness thereof.

Alternatively, the hole 24 may be a blind hole which is opened to the first member 1 to be joined and does not extend through the member 23 in the direction of thickness thereof.

As shown in (*a*) of FIG. 4, inserted in the holes 24, 3 and 22 is the auxiliary member 7.

The fastening member 23 may be preliminarily fixed to the first member 1 to be joined by welding or other technique.

As shown in (*d*) of FIG. 4, the material derived from the auxiliary member 7 is closely contacted, due to frictional heat and plastic flow, with the inner periphery of the hole 3 of the first member 1 and to be assimilated with the fastening member 23 and the second member 2, thus the first and second members 1 and 21 being joined together by the auxiliary member 7.

The above-mentioned shaping of the auxiliary member 7 is conducted, using a backing member 6 and a joining tool 10.

While rotated, the joining tool 10 is pushed on an end surface, on the side adjacent to the second member 21, of the auxiliary member 7 supported by the backing member 6, so that the auxiliary member 7 is softened due to frictional heat and plastic flow by shown in (*b*) of FIG. 4.

Then, as shown in (*c*) of FIG. 4, the material derived from the auxiliary member 7 is assimilated with the fastening member 23 and the second member 2 to be joined.

Further, as shown in (*d*) of FIG. 4, the joining tool 10 is released from the auxiliary member 7 to allow the plastic flow portion of the auxiliary member 7 assimilated with the second member 2 and the plastic flow portion of the auxiliary member 7 assimilated with the fastening member 23 to solidify, thus completing the joining of the first and second members 1 and 21 to be joined.

Thus, even if the first member 1 to be joined is made of aluminum alloy just like the second member 21 to be joined or made of material other than aluminum alloy which is significantly different in hardness, softening temperature and other properties, thus the members 1 and 21 to be joined can be efficiently and reliably joined together.

If the first member 1 to be joined is made of aluminum alloy just like the auxiliary member 7, the material derived from the auxiliary member 7 is assimilated with the first member 1 to be joined.

If the first member 1 to be joined is relatively thin in comparison with the second member 21 to be joined 21, advisably the fastening member 23 may be preliminarily fixed to the first member 1 to be joined by welding or other technique. Such preliminary fixing brings about dispersion of shearing force applied by the fastening member 23 to the auxiliary member 7, and prevents rupture of the auxiliary member 7 even if forces are applied to the first and second members 1 and 21 to be joined in mutually shifted directions and prevents the first member 1 to be joined from being peeled.

Figure 5:
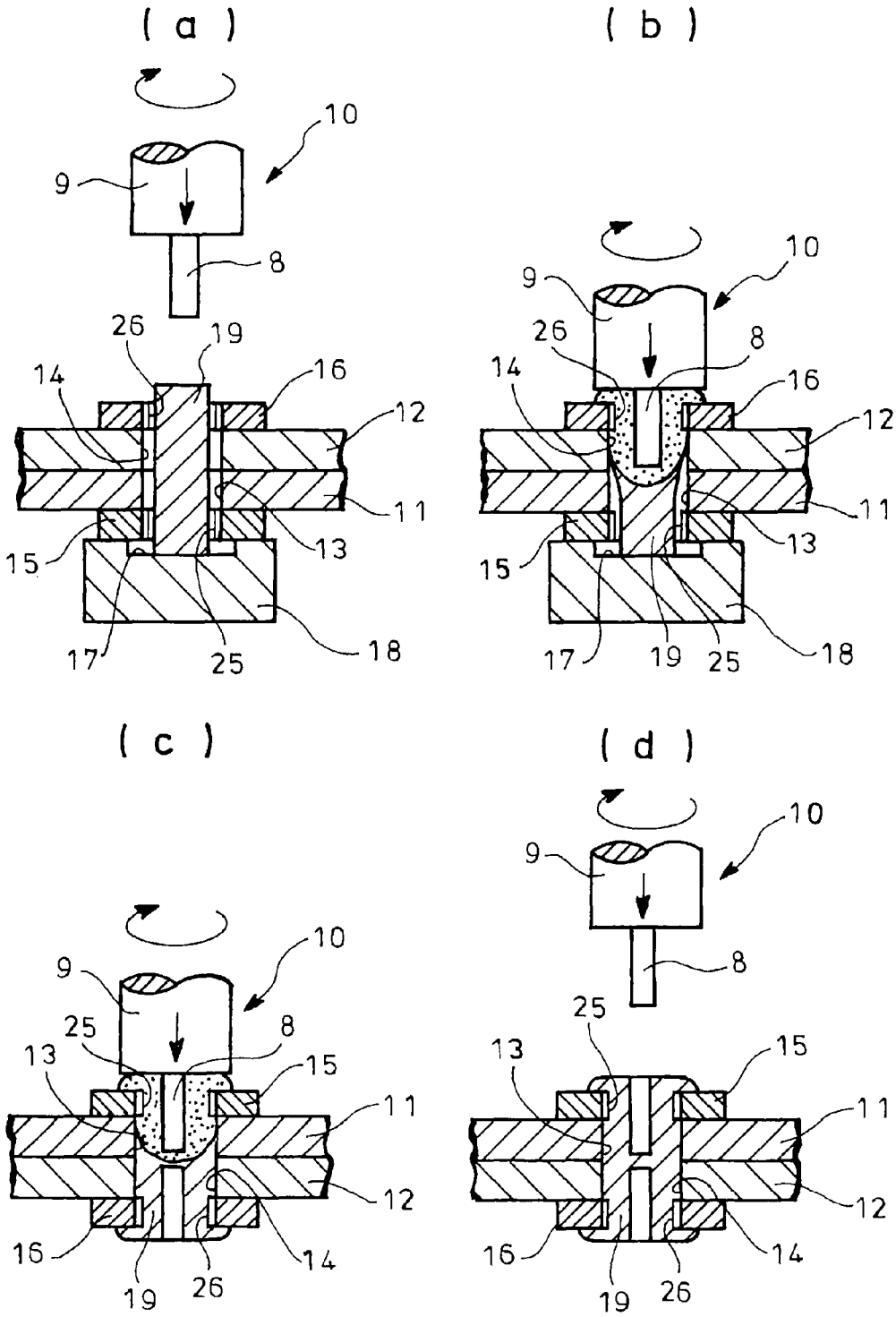
FIG. 5 includes schematic diagrams showing construction sequence of a fifth embodiment for a structure for joining members according to the invention.

FIG. 5 is directed to a fifth embodiment of a structure for joining members according to the invention.

The structure for joining members comprises first and second plate-like members 11 and 12 to be joined which are stacked one on the other for face-to-face contact, a first fastening member 15 abutting on the first member 11 to be joined on a side way from the second member 12 to be joined, a second fastening member 16 abutting on the second member 12 on a side away from the first member 11 to be joined, and an auxiliary member 19.

The auxiliary member 19 is made of aluminum alloy, the first and second fastening members 15 and 16 being made of steel harder and higher in softening temperature than aluminum alloy.

The first and second members 11 and 12 to be joined are formed with holes 13 and 14, respectively, which are coaxial and extend through the respective members in a direction of thickness thereof.

The first and second fastening members 15 and 16 are formed with threaded holes 25 and 26, respectively, which are coaxial with the holes 13 and 14 of the first and second members 11 and 12 to be joined and which extend through the respective members in the direction of thickness thereof.

Alternatively, the holes 25 and 26 may be not threaded holes but mere holes extending through the direction of thickness thereof.

As shown in (*a*) of FIG. 5, inserted in the holes 25, 13, 14 and 26 is the auxiliary member 19.

The first and second fastening members 15 and 16 may be preliminarily fixed to the first and second members 11 and 12 to be joined, respectively, by welding or other technique.

As shown in (*d*) of FIG. 5, the material derived from the auxiliary member 19 is closely contacted, due to frictional heat and plastic flow, with the inner periphery of the threaded hole 25 of the first fastening member 15, the inner peripheries of the holes 13 and 14 of the first and second members 11 and 12 to be joined and the inner periphery of the threaded hole 26 of the second fastening member 16 and caused to cover circumferences of the threaded holes 25 and 26 of the first and second fastening members 15 and 16, thus the first and second members 11 and 12 to be joined being joined together by the auxiliary member 19.

The above-mentioned shaping of the auxiliary member 19 is conducted, using a backing member 18 and a joining tool 10.

The backing member 18 and the joining tool 10 is made of steel harder and higher in softening temperature than aluminum alloy.

The joining tool 10 comprises a short cylindrical pin 8 coaxially contiguous with a tip end of a cylindrical shoulder 9. The backing member 18 serves to receive the members 15 and 19.

The backing member 18 is formed with, at a center of its portion receiving the fastening members 15 and 16, a recess 17 adapted to support the end surface of the auxiliary member 19.

While rotated, the joining tool 10 is pushed on an end surface, on a side adjacent to the second member 12, of the auxiliary member 19 supported by the backing member 18, so that the auxiliary member 19 is softened due to frictional heat and plastic flow as shown in (*b*) of FIG. 5. The material derived from the auxiliary member 19 enters a threaded groove of the threaded hole 26 and covers the circumference of the hole 26 of the second fastening member 16.

Then, the joining tool 10 is released from the auxiliary member 19 to allow the material derived from the auxiliary member 19 and covering the circumference of the threaded hole 26.

Then, as shown in 5(*c*) of FIG. 5, first and second members 11 and 12 are turned upside down, the end of the auxiliary member 19 adjacent to the second member 12 is received by the backing member (not shown). While rotated, the auxiliary member 19 is pushed on an end surface of the first member 11 to be joined, so that the auxiliary member 19 is softened due to frictional heat and plastic flow. The material derived from the auxiliary member 19 enters a threaded groove of the threaded hole 25 and covers a circumference of the hole 25 of the first fastening member 15.

Then, as shown in (*d*) of FIG. 5, the joining tool 10 is released from the auxiliary member 19 and to allow the material derived from the auxiliary member 19 covering the circumference of the threaded hole 25 to solidify, thus completing the joining of the first and second members 11 and 12 to be joined.

Thus, even if the first and second members 11 and 12 to be joined are made of materials such as steel on the one hand and aluminum alloy on the other hand which are significantly different in hardness, softening temperature and other properties, thus the members 11 and 12 to be joined can be efficiently and reliably joined together.

If the first and second members 11 and 12 to be joined are made of aluminum alloy just like the auxiliary member 19, the material derived from the auxiliary member 19 is assimilated with the first and second members 11 and 12 to be joined.

Figure 6:
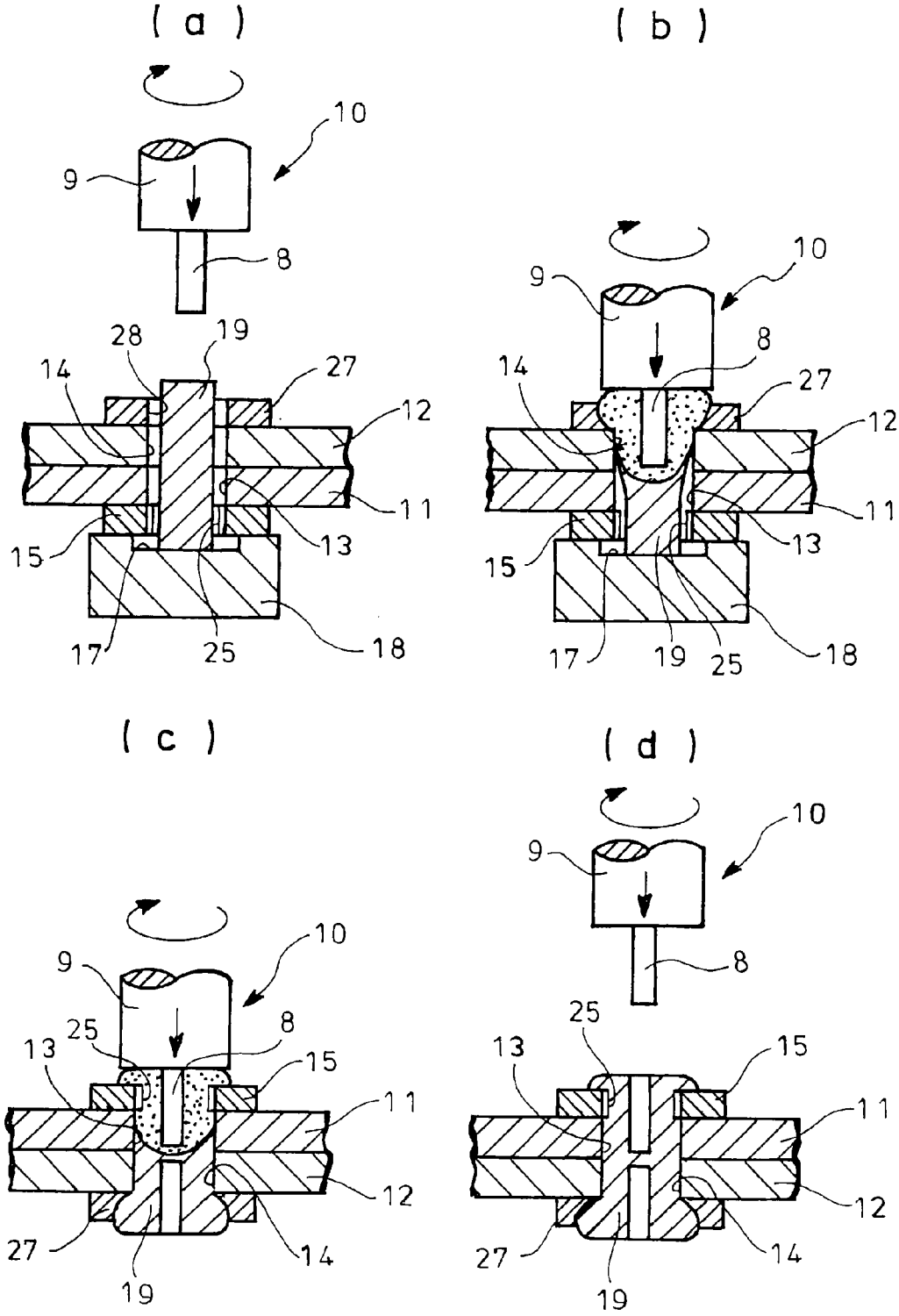
FIG. 6 includes schematic diagrams showing construction sequence of a sixth embodiment for a structure for joining members according to the invention.

FIG. 6 is directed to a sixth embodiment of a structure for joining members according to the invention in which parts similar to those in FIG. 5 are represented by the same reference numerals.

The structure for joining members comprises first and second members 11 and 12 to be joined, a first fastening member 15 abutting on the first member 11 on a side away from the second member 12 to be joined, a second fastening member 27 abutting on the second member 12 on a side away from the first member 11 to be joined, and an auxiliary member 19.

The second fastening member 27 is made of aluminum alloy just like the auxiliary member 19.

The second fastening member 27 is formed with a hole 28 which is coaxial with the holes 13 and 14 of the first and second members 11 and 12 to be joined and extends through the member 27 in a direction of thickness thereof.

As shown in (*a*) of FIG. 6, inserted in the holes 25, 13, 14 and 28 is the auxiliary member 19.

The first and second fastening members 15 and 27 may be preliminarily fixed to the first and second members 11 and 12 to be joined, respectively, by welding or other technique.

As shown in (*d*) of FIG. 6, the material derived from the auxiliary member 19 is closely contacted, due to frictional heat and plastic flow, with the inner periphery of the hole 25 of the first fastening member 15 and the inner peripheries of the holes 13 and 14 of the first and second members 11 and 12 to be joined and cover the circumference of the hole 25 of the first fastening member 15 and assimilated with the second fastening member 27, whereby the first and second members 11 and 12 to be joined are joined together by the auxiliary member 19.

The above-mentioned shaping of the auxiliary member 19 is conducted, using a backing member 18 and a joining tool 10.

The backing member 18 serves to receive the first fastening member 15 and the auxiliary member 19.

While rotated, the joining tool 10 is pushed on an end surface, on a side adjacent to the second member 12 to be joined, of the auxiliary member 19 supported by the backing member 18, so that the auxiliary member 19 is softened due to frictional heat and plastic flow and the material derived from the auxiliary member 19 is assimilated with the second fastening member 27 as shown (*b*) of FIG. 6.

Then, the joining tool 10 is released from the auxiliary member 19 to allow the material derived from the auxiliary member 19 and assimilated with the second fastening member 27 to solidify.

Then, as shown in (*c*) of FIG. 6, the first and second members 11 and 12 to be joined are turned upside down, an end of the auxiliary member 19 on a side adjacent to the second member 12 to be joined being received by the backing member (not shown). While rotated, the joining tool 10 is pushed on an end of the auxiliary member 19 on a side adjacent to the first member 11 to be joined, the auxiliary member 19 is softened due to frictional heat and plastic flow. The material derived from the auxiliary member 19 enters into a threaded groove of the threaded hole 25 and covers a circumference of the threaded hole 25 of the first fastening member 15.

Then, as shown in (*d*) of FIG. 6, the joining tool 10 is released from the auxiliary member 19 to allow the material derived from the auxiliary member 19 covering the circumference of the threaded hole 25 to solidify, thus completing the joining of the first and second members 11 and 12 to be joined.

Thus, even if the first and second members 11 and 12 to be joined are made of materials such as steel on the one hand and aluminum alloy on the other hand which are significantly different in hardness, softening temperature and other properties, thus the members 11 and 12 to be joined can be efficiently and reliably joined together.

If the first and second members 11 and 12 to be joined are made of aluminum alloy just like the auxiliary member 19, the material derived from the auxiliary member 19 is assimilated with the first and second members 11 and 12 to be joined.

Figure 7:
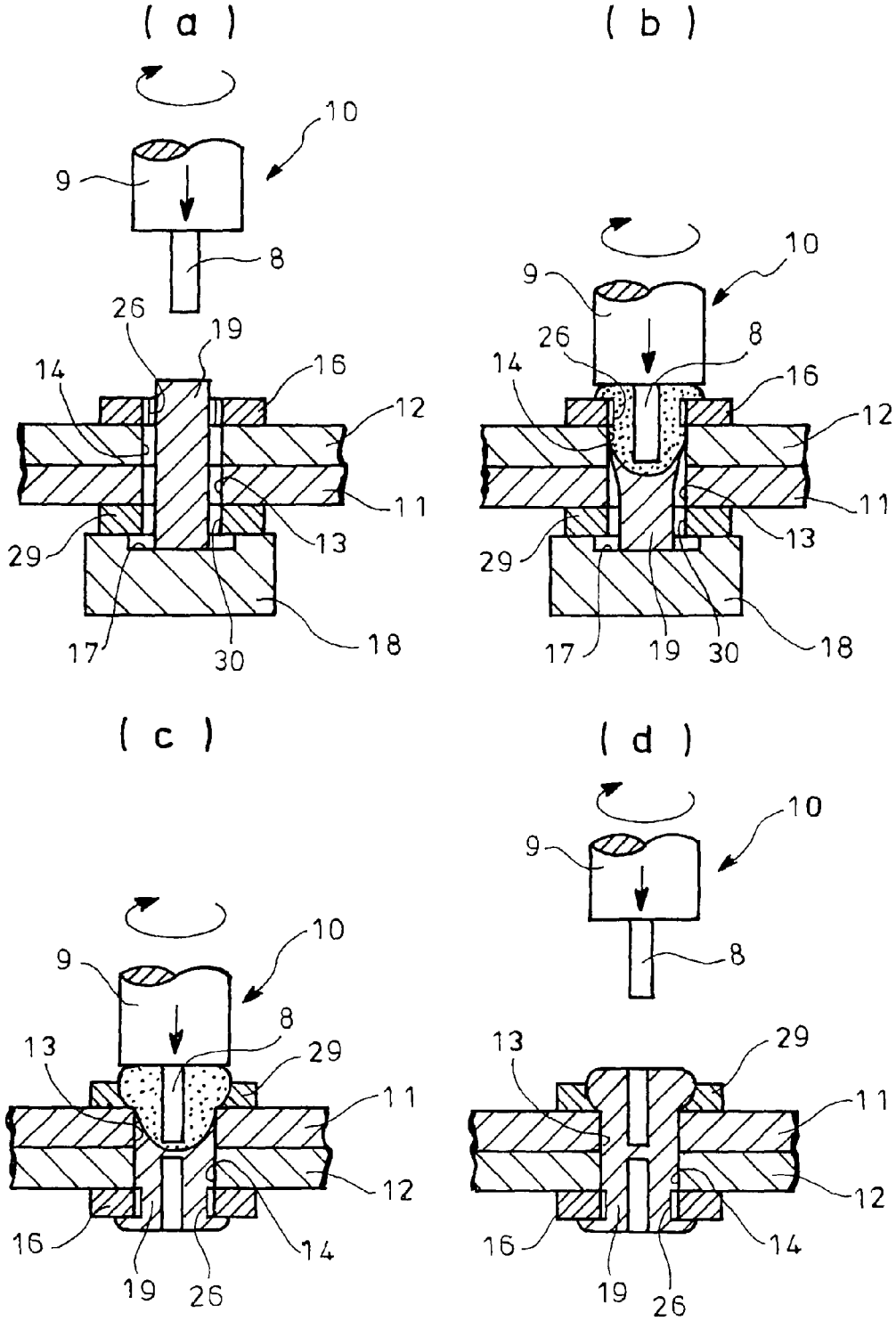
FIG. 7 includes schematic diagrams showing construction sequence of a seventh embodiment for a structure for joining members according to the invention.

FIG. 7 is directed to a seventh embodiment of a structure for joining members according to the invention in which parts similar to those in FIG. 5 are represented by the same reference numerals.

The structure for joining members comprises first and second members 11 and 12 to be joined, a first fastening member 29 abutting on the first member 11 on a side away from the second member 12 to be joined, a second fastening member 16 abutting on the second member 23 on a side away from the first member 11 to be joined, and an auxiliary member 19.

The first fastening member 29 is made of aluminum alloy just like the auxiliary member 19.

The first fastening member 29 is formed with a hole 30 which is coaxial with the holes 13 and 14 of the first and second members 11 and 12 to be joined and which extend through the member 29 in a direction of thickness thereof.

As shown in (*a*) of FIG. 7, inserted in the hole 30, 13, 14 and 26 is the auxiliary member 19.

The first and second fastening members 29 and 16 may be preliminarily fixed to the first and second members 11 and 12 to be joined, respectively, by welding or other technique.

As shown in (*d*) of FIG. 7, due to frictional heat and plastic flow, the material derived from the auxiliary member 19 is assimilated with the first fastening member 29 and closely contacted with the inner peripheries of the holes 13, 14 and 26 of the members 11, 12 and 16 and caused to cover a circumference of the threaded hole 26 of the second fastening member 16, whereby the first and second members 11 and 12 to be joined are joined together by the auxiliary member 19.

The above-mentioned shaping of the auxiliary member 19 is conduced, using a backing member 18 and a joining tool 10.

The backing member 18 serves to receive the members 29 and 19.

While rotated, the joining tool 10 is pushed on an end surface, on a side adjacent to the second member 12 to be joined, of the auxiliary member 19 supported by the backing member 18, so that as shown in (*b*) of FIG. 7, the auxiliary member 19 is softened due to frictional heat and plastic flow. The material derived from the auxiliary member 19 enters into a threaded groove of the threaded hole 26 and covers a circumference of the threaded hole 26 of the second fastening member 16.

Then, the joining tool 10 is released from the auxiliary member 19 to allow the material derived from the auxiliary member 19 covering the circumference of the threaded hole 26 to solidify.

Then, as shown in (*c*) of FIG. 7, the first and second members 11 and 12 to be joined are turned upside down, an end of the auxiliary member 19 adjacent to the second member 12 being received by the backing member (not shown). While rotated, the joining tool 10 is pushed on an end surface of the auxiliary member 19 adjacent to the first member 11, so that due to frictional heat and plastic flow the auxiliary member 19 is softened and the material derived from the auxiliary member 19 is assimilated with the first fastening member 29.

Then, the joining tool 10 is released from the auxiliary member 19 to allow the material derived from the auxiliary member 19 and assimilated with the first fastening member 29 to solidify, thus completing the joining of the first and second members 11 and 12 to be joined.

Thus, even if the first and second members 11 and 12 to be joined are made of materials such as steel on the one hand and aluminum alloy on the other hand which are significantly different in hardness, softening temperature and other properties, thus the members 11 and 12 can be efficiently and reliably joined together.

If the first and second members 11 and 12 to be joined are made of aluminum alloy just like the auxiliary member 19, the material derived from the auxiliary member 19 is assimilated with the first and second members 11 and 12 to be joined.

Figure 8:
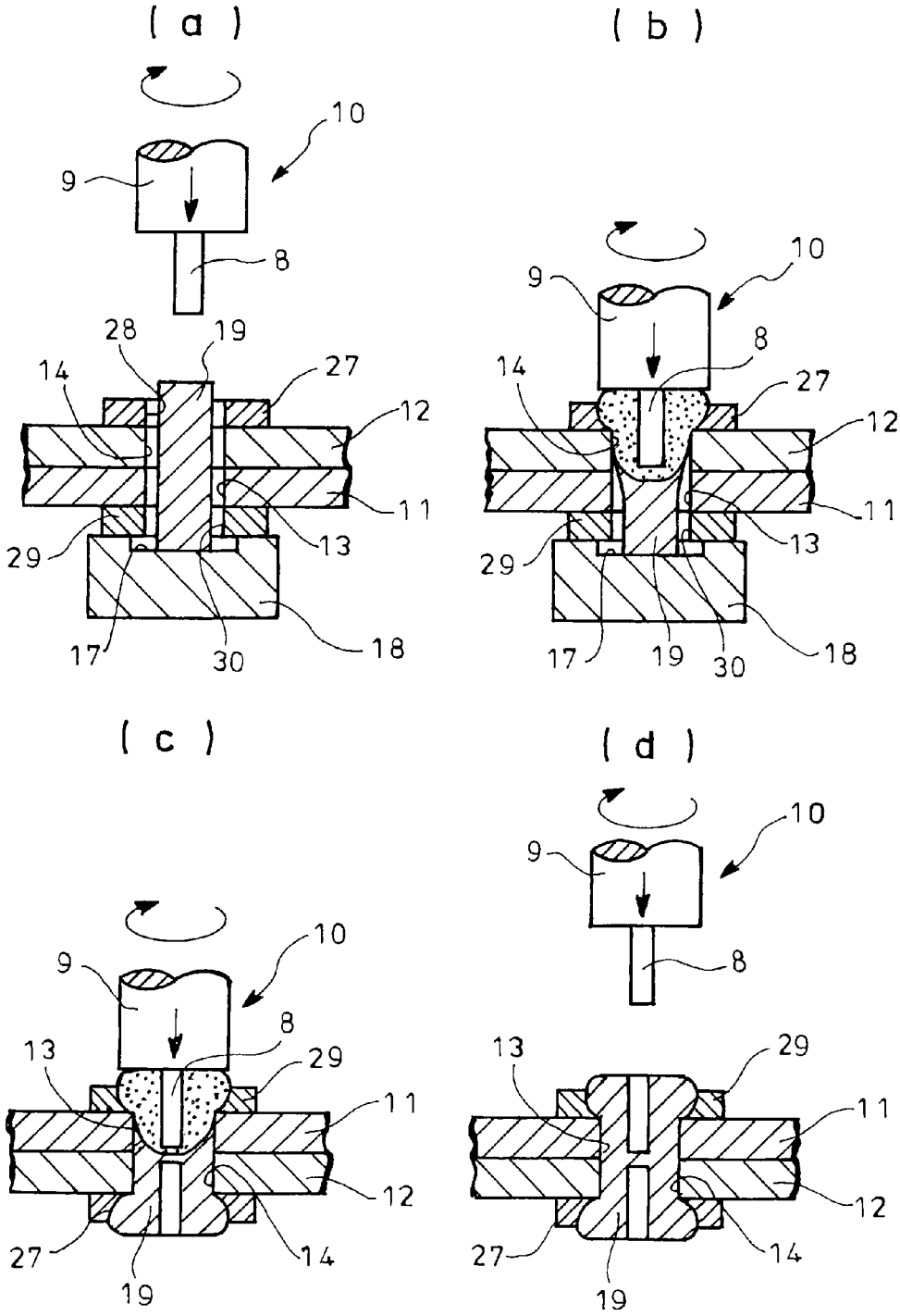
FIG. 8 includes schematic diagrams showing construction sequence of an eighth embodiment for a structure for joining members according to the invention.

FIG. 8 is directed to an eighth embodiment of a structure for joining members according to the invention in which parts similar to those in FIGS. 6 and 7 are represented by the same reference numerals.

The structure for joining members comprises first and second members 11 and 12 to be joined, a first fastening member 29 abutting on the first member 11 on a side away from the second member 12 to be joined, a second fastening member 27 abutting on the second member 12 on a side away from the first member 11 to be joined, and an auxiliary member 19.

The first and second fastening members 29 and 27 are made of aluminum alloy just like the auxiliary member 19.

The first and second fastening members 29 and 27 are formed with holes 30 and 28, respectively, which are coaxial with the holes 13 and 14 of the first and second members 11 and 12 to be joined and which extend through the respective members 29 and 27 in a direction of thickness thereof.

As shown in (*a*) of FIG. 8, inserted in the holes 30, 13, 14 and 28 is the auxiliary member 19.

The first and second fastening members 29 and 27 may be preliminarily fixed to the first and second members 11 and 12 to be joined, respectively, by welding or other technique.

As shown in (*d*) of FIG. 8, due to frictional heat and plastic flow, the material derived from the auxiliary member 19 is assimilated with the first fastening member 29 and closely contacted with the inner peripheries of the holes 13 and 14 of the first and second members 11 and 12 to be joined and is assimilated with the second fastening member 27, whereby the first and second members 11 and 12 to be joined are joined together by the auxiliary member 19.

The above-mentioned shaping of the auxiliary member 19 is conducted, using a backing member 18 and a joining tool 10.

The backing member 18 serves to receive the members 29 and 19.

While rotated, the joining tool 10 is pushed on an end surface, on a side adjacent to the second member 12 to be joined, of the auxiliary member 19 supported by the backing member 18, so that as shown in (*b*) of FIG. 8, due to frictional heat and plastic flow the auxiliary member 19 is softened and material derived from the auxiliary member 19 is assimilated with the second fastening member 27.

Then, the joining tool 10 is released from the auxiliary member 19 to allow the material derived from the auxiliary member 19 and assimilated with the second fastening member 27 to solidify.

Then, as shown in (*c*) of FIG. 8, the first and second members 11 and 12 to be joined are turned upside down, an end of the auxiliary member 19 adjacent to the second member 12 to be joined being received by the backing member (not shown). While rotated, the joining tool 10 is pushed on an end surface, on a side adjacent to the first member 11 to be joined, of the auxiliary member 19, so that due to frictional heat and plastic flow the auxiliary member 19 is softened and the material derived from the auxiliary member 19 is assimilated with the first fastening member 29.

Then, the joining tool 10 is released from the auxiliary member 19 to allow the material derived from the auxiliary member 19 and assimilated with the first fastening member 29 to solidify, thus completing the joining of the first and second members 11 and 12 to be joined.

Thus, even if the first and second members 11 and 12 to be joined are made of materials such as steel on the one hand and aluminum alloy on the other hand which are significantly different in hardness, softening temperature and other properties, thus the members 11 and 12 can be efficiently and reliably joined together.

If the first and second members 11 and 12 to be joined are made of aluminum alloy just like the auxiliary member 19, the material derived from the auxiliary member 19 is assimilated with the first and second members 11 and 12 to be joined.

It is to be understood that a structure for joining members according to the invention is not limited to the above embodiments and that various changes and modifications may be made without departing from the scope of the invention.

Industrial Applicability

A structure for joining members according to the invention is applicable to joining and assembling of various parts and components.

The invention claimed is:

1. A structure for joining first and second members, said first and second members to be joined are stacked one on the other for face-to-face contact and formed with respective, mutually contiguous holes, the structure comprising:

a nut with a threaded hole contiguous with said holes of the first and second members, and welded to the first member on a side away from the second member; and an auxiliary member inserted into the threaded hole of said nut and the holes of the first and second members, said auxiliary member being pushed by a rotating joining tool into softness due to frictional heat and plastic flow, said softened auxiliary member solidifying after entering into a threaded groove of said threaded hole and covering a circumference of said hole of the second member.

2. A structure for joining first and second members, said first and second members to be joined are stacked one on the other for face-to-face contact and formed with respective, mutually contiguous holes, the structure comprising:

a nut with a threaded hole contiguous with said holes of the first and second members, and welded to the first member on a side away from the second member; and an auxiliary member inserted into the threaded hole of said nut and the holes of the first and second members, an inner surface defining the opening of the nut being formed with a threaded groove, said auxiliary member being pushed by a rotating joining tool into softness due to frictional heat and plastic flow, said softened auxiliary member solidifying after entering into said groove on the inner surface defining the opening of the nut and cover a circumference of the hole of the second member to be joined.

3. A structure for joining first and second members, said first and second members to be joined are stacked one on the other for face-to-face contact and formed with respective, mutually contiguous holes, the structure comprising:

a nut with a threaded hole contiguous with said holes of the first and second members to be joined and abutting on the first member on a side away from the second member to be joined; and an auxiliary member inserted into the opening of said nut and said holes of the first and second members to be joined, material derived from the auxiliary member due to frictional heat and plastic flow being adapted to engage with the threaded hole of the nut and be assimilated with the second member to be joined.

4. A structure for joining first and second members, said first and second members to be joined are stacked one on the other for face-to-face contact and formed with respective, mutually contiguous holes, the structure comprising:

a nut with a threaded hole contiguous with said holes of the first and second members to be joined and abutting on the first member on a side away from the second member; and an auxiliary member inserted into the threaded hole of said nut and said holes of the first and second members to be joined, an inner surface defining the opening of the nut being formed with a threaded groove, wherein material derived from the auxiliary member due to frictional heat and plastic flow being adapted to enter into said groove on the inner surface defining the opening of the nut and be assimilated with the second member to be joined.

5. A structure for joining first and second members, said first and second members to be joined are stacked one on the other for face-to-face contact and formed with respective, mutually contiguous holes, the structure comprising:

a nut with a threaded hole contiguous with said holes of the first and second members to be joined and abutting on the first member on a side away from the second member to be joined; and an auxiliary member inserted into the opening of said nut and said holes of the first and second members, wherein material derived from the auxiliary member due to frictional heat and plastic flow being adapted to be assimilated with a threaded groove of said threaded hole and engage with the second member.

6. A structure for joining first and second members, said first and second members to be joined are stacked one on the other for face-to-face contact and formed with respective, mutually contiguous holes, the structure comprising:

a nut with a threaded hole contiguous with said holes of the first and second members to be joined and abutting on the first member on a side away from the second member to be joined; and an auxiliary member inserted into the threaded hole of said nut and said holes of the first and second members to be joined, wherein material derived from the auxiliary member due to frictional heat and plastic flow being adapted to be assimilated with the threaded hole of the nut and cover a circumference of the hole of the second member to be joined.

7. A structure for joining first and second members, said first and second members to be joined are stacked one on the other for face-to-face contact and formed with respective, mutually contiguous holes, the structure comprising:

a nut with a threaded hole contiguous with said holes of the first and second members to be joined and abutting on the first member on a side away from the second member to be joined; and an auxiliary member inserted into the threaded hole of the nut and said holes of the first and second members to be joined, wherein material derived from the auxiliary member due to frictional heat and plastic flow being adapted to be assimilated with a threaded groove of the threaded hole and second member.

8. A structure for joining first and second members, said first and second members to be joined are stacked one on the other for face-to-face contact and formed with respective, mutually contiguous holes, the structure comprising:

a first nut with threaded hole contiguous with said holes of the first and second members to be joined and abutting on the first member to be joined on a side away from the second member to be joined;

a second nut with threaded hole contiguous with the holes of said first and second members to be joined and abutting on the second member to be joined on a side away from said first member to be joined; and an auxiliary member inserted into the hole of the first nut, the holes of the first and second members to be joined and the hole of the second nut, material derived from the auxiliary member due to frictional heat and plastic flow being adapted to engage with the threaded holes of the first and second nuts.

9. A structure for joining first and second members, said first and second members to be joined are stacked one on the other for face-to-face contact and formed with respective, mutually contiguous holes, the structure comprising:

a first nut with a threaded hole contiguous with said holes of the first and second members to be joined and abutting on the first member to be joined on a side away from the second member to be joined;

a second nut with a threaded hole contiguous with said holes of the first and second members to be joined and abutting on the second member to be joined on a side away from the first member to be joined; and an auxiliary member inserted into the hole of the first nut, the holes of the first and second members to be joined and the hole of the second nut, material derived from the auxiliary member due to frictional heat and plastic flow being adapted to cover circumferences of the threaded holes of the first and second nuts.

10. A structure for joining first and second members, said first and second members to be joined are stacked one on the other for face-to-face contact and formed with respective, mutually contiguous holes, the structure comprising:

a first nut with a threaded hole contiguous with said holes of the first and second members to be joined and abutting on the first member to be joined on a side away from the second member to be joined;

a second nut with a threaded hole contiguous with said holes of the first and second members to be joined and abutting on the second member to be joined on a side away from the first member to be joined; and an auxiliary member inserted into the hole of the first nut, the holes of the first and second members to be joined and the hole of the second nut, material derived from the auxiliary member due to frictional heat and plastic flow being adapted to engage with a threaded groove of the threaded hole of the first nut and be assimilated with the second nut.

11. A structure for joining first and second members, said first and second members to be joined are stacked one on the other for face-to-face contact and formed with respective, mutually contiguous holes, the structure comprising:

a first nut with a threaded hole contiguous with said holes of the first and second members to be joined and abutting on the first member to be joined on a side away from the second member to be joined;

a second nut with a threaded hole contiguous with said holes of the first and second members to be joined and abutting on the second member to be joined on a side away from the first member to be joined; and an auxiliary member inserted into the hole of the first nut, the holes of the first and second members to be joined and the hole of the second nut, material derived from the auxiliary member due to frictional heat and plastic flow being adapted to cover a circumference of the hole of the first nut and be assimilated with the second nut.

12. A structure for joining first and second members, said first and second members to be joined are stacked one on the other for face-to-face contact and formed with respective, mutually contiguous holes, the structure comprising:

a first nut with a threaded hole contiguous with said holes of the first and second members to be joined and abutting on the first member to be joined on a side away from the second member to be joined;

a second nut with a threaded hole contiguous with said holes of the first and second members to be joined and abutting on the second member to be joined on a side away from the first member to be joined; and an auxiliary member inserted into the hole of the first nut, the holes of the first and second members to be joined and the hole of the second nut, wherein material derived from the auxiliary member due to frictional heat and plastic flow being adapted to be assimilated with a threaded groove of the threaded hole of the first nut and engage with the second nut.

13. A structure for joining first and second members, said first and second members to be joined are stacked one on the other for face-to-face contact and formed with respective, mutually contiguous holes, the structure comprising:

a first nut with a threaded hole contiguous with said holes of the first and second members to be joined and abutting on the first member to be joined on a side away from the second member to be joined;

a second nut with a threaded hole contiguous with said holes of the first and second members to be joined and abutting on the second member to be joined on a side away from the first member to be joined; and an auxiliary member inserted into the hole of the first nut, the holes of the first and second members to be joined and the hole of the second nut, material derived from the auxiliary member due to frictional heat and plastic flow being adapted to be assimilated with the first nut and cover a circumference of the hole of the second nut.

14. A structure for joining first and second members, said first and second members to be joined are stacked one on the other for face-to-face contact and formed with respective, mutually contiguous holes, the structure comprising:

a first nut with a threaded hole contiguous with said holes of the first and second members to be joined and abutting on the first member to be joined on a side away from the second member to be joined;

a second nut with a threaded hole contiguous with said holes of the first and second members to be joined and abutting on the second member to be joined on a side away from the first member to be joined; and an auxiliary member inserted into the hole of the first nut, the holes of the first and second members to be joined and the hole of the second nut, wherein material derived from the auxiliary member due to frictional heat and plastic flow being adapted to be assimilated with a threaded groove of the threaded holes of the first and second nuts.

15. The structure as claimed in claim 1, wherein the auxiliary member is made of aluminum alloy.

16. The structure as claimed in claim 15, wherein the second member and the nut are made of steel and have a higher softening temperature than the aluminum alloy.

* * * * *